US006935438B2

(12) United States Patent
Hofmann et al.

(10) Patent No.: US 6,935,438 B2
(45) Date of Patent: Aug. 30, 2005

(54) BATTERY OPERATED ELECTRICAL TOOL

(75) Inventors: Albrecht Hofmann, Steinenbronn (DE); Harald Krondorfer, Ludwigsburg (DE); Markus Heckmann, Filderstadt (DE); Thomas Schomisch, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/110,156

(22) PCT Filed: Jun. 16, 2001

(86) PCT No.: PCT/DE01/02243

§ 371 (c)(1),
(2), (4) Date: Jul. 8, 2002

(87) PCT Pub. No.: WO02/14029

PCT Pub. Date: Feb. 21, 2002

(65) Prior Publication Data

US 2003/0115995 A1 Jun. 26, 2003

(30) Foreign Application Priority Data

Aug. 16, 2000 (DE) ..... 100 39 777

(51) Int. Cl.[7] ..... B23B 45/00
(52) U.S. Cl. ..... 173/217
(58) Field of Search ..... 173/217, 164, 173/170; 310/47, 50

(56) References Cited

U.S. PATENT DOCUMENTS 4,912,349 A 3/1990 Chang
4,976,173 A 12/1990 Yang
5,664,634 A 9/1997 McCracken
5,842,506 A * 12/1998 Peters ..... 140/119
D418,729 S * 1/2000 Snider ..... D8/61
6,102,134 A * 8/2000 Alsruhe ..... 173/217
6,139,359 A * 10/2000 Fuhreck et al. ..... 439/500
6,199,642 B1 * 3/2001 Becker et al. ..... 173/217
6,218,746 B1 * 4/2001 Gouge, Jr. ..... 310/50

FOREIGN PATENT DOCUMENTS

WO 99 49553 A 9/1999

* cited by examiner

*Primary Examiner*—Rinaldi I. Rada
*Assistant Examiner*—Brian Nash
(74) *Attorney, Agent, or Firm*—Michael J. Striker

(57) ABSTRACT

A battery-operated electrical tool (10) is provided with a machine housing (11) that has a longish, substantially rod-shaped housing portion (12) containing an electric drive motor (13) and an end portion (15) on which a terminal connection surface (16) with push-in receptacle (17) for the detachable attachment of a battery packet (14) is provided, which said battery packet is provided with a connection part (18) that comprises a seating surface (19) matched to the connection surface (16) for seating on said connection surface, and comprising a push-in part (20) engaging in the push-in receptacle (17). The end portion (15) is inflected toward one side in relation to the housing portion (12) out of the direction of longitudinal extension. The terminal connection surface (16) of the end portion (15) extends within a plane (21) that is oriented skew in relation to a plane (22) extending substantially perpendicularly to the longitudinal axis (23) of the housing portion (12).

9 Claims, 1 Drawing Sheet

BATTERY OPERATED ELECTRICAL TOOL

This application is a 371 of PCT/DE01/02243 filed on Jun. 16, 2001 and claiming priority to German application 100 39 777.8 filed on Aug. 16, 2000.

BACKGROUND OF THE INVENTION

The invention is based on a battery-operated electrical tool such as an angle grinder, die grinder, finecut power handsaw, or a similar power tool.

Electrical tools of this type having substantially rod-shaped machine housing or housing portion are known in which the battery packet is attached at the end of the end portion in such a detachable fashion that the battery packet abuts the latter in the direction of the longitudinal axis, extending the housing. As a result, the housing becomes longer than is the case with comparable power tools operated using a power supply cord. This is a disadvantage for more than just aesthetic reasons. Rather, the handiness of the electrical tool is impaired due to the weight of the battery packet attached to the end. Additionally, the battery packet is occasionally perceived as irritating while working in a cramped position.

SUMMARY OF THE INVENTION

In contrast, the battery-operated electrical tool according to the invention has the advantage that the battery packet blends harmoniously into the overall appearance of the electrical tool, so that a harmonious overall impression is created. It is further possible to keep the overall length of the electrical tool to a minimum despite the battery packet, and to realize a shorter, handler design under certain conditions, whereby a substantially rod-shaped electrical tool is less tall-heavy. It is further an advantage that, due to the inflected arrangement of the battery packet, said battery packet is no longer an obstacle during operation in many cases nor is it annoyingly in the way in any other fashion. This applies for angle grinders, for example, that have been successfully designed so that the battery packet does not project over the plane of the sanding disc. A further advantage is the fact that, due to the tilted position of the battery packet, the operator of the electrical tool, e.g., In the form of an angle grinder, is effectively prevented from setting the electrical tool down on the batter packet while the electrical tool is still running or after shutoff but with the tool, e.g., the sanding disc, still running if the electrical tool would tip over with the tool running, serious risk of injury would exist.

If an angle of inflection of the battery packet is selected within a specified range, the advantages described above can be improved even further when the angle of inflection is greater. The electrical tool can be designed even shorter end handier while further reducing the tall-heaviness. The space available under the neck of the battery packet can be used for arranging the switch of the electrical tool, thereby making an even shorter, handier design possible.

The user can move the battery packet into a swivel position which is optimal for the application at that time. By swiveling the end portion, said end portion with the battery packet can therefore be moved into positions that do not pose a hindrance or interrupt operation, even in a cramped position.

BRIEF DESCRIPTION OF THE DRAWINGS

The invention is explained in greater detail below using exemplary embodiments shown in the drawing.

DETAILED DESCRIPTION OF THE PREFERRED EMBODIMENTS

Figure 1:
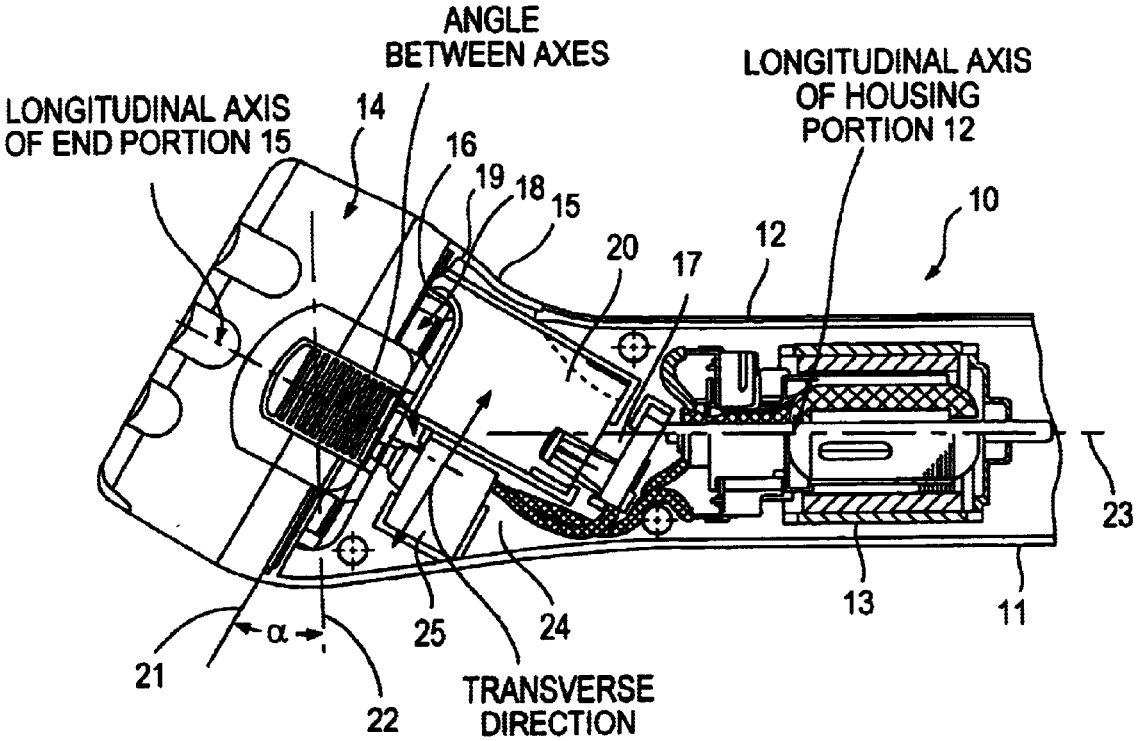
FIG. 1 shows a side view with partial longitudinal cut of a portion of a battery-operated electrical tool according to a first exemplary embodiment, FIG. 2 a schematic side view of a portion of a battery-operated electrical tool according to a second exemplary embodiment.
Figure 2:
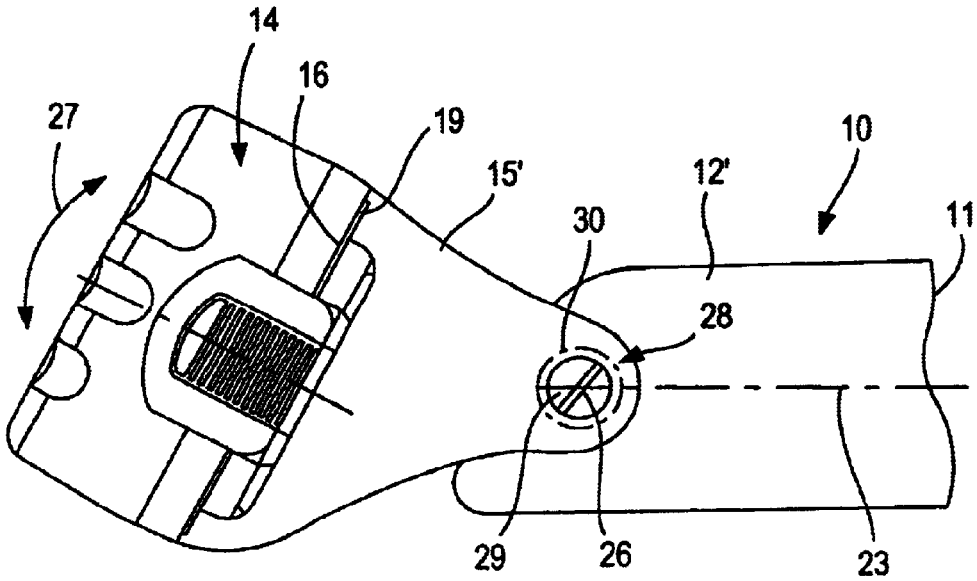

A portion of an electrical tool 10 is shown in FIGS. 1 and 2 that comprises an angle grinder, a die grinder, a finecut power handsaw or the like. The electrical tool 10 comprises a machine housing 11 having a longish, substantially rod-shaped housing portion 12 containing an electric drive motor 13. The drive motor 13 is battery-operated, by a battery packet 14, in fact, shown only schematically in side view in FIGS. 1 and 2, and which is basically known. The battery packet 14 contains, in known fashion, at least one not shown battery cell, and it is capable of being attached to the electrical tool 10 in detachable fashion. The substantially rod-shaped housing portion 12 comprises an end portion 15, which is a single-pieced component of the housing portion 12 in the first exemplary embodiment in FIG. 1. This end portion 15 has a terminal connection surface 16 with push-in receptacle 17 for the battery packet 14 which is provided with a socket-like connection part 18 in known fashion, which said socket-like connection part comprises a seating surface 19 matched to the connection surface 16 for seating on said connection surface, and moreover comprises a push-in part 20 which engages into the push-in receptacle 17 or is capable of being brought into a positive connection with said push-in receptacle in any other fashion while, at the same time, establishing the respective electrical connections. To this extent, the design itself of the electrical tool 10 shown in FIG. 1 is known.

The novel feature of the electrical tool 10 lies in the fact that the terminal connection surface 16 of the end portion 15 extends within a plane 21 that is oriented skew to a plane 22 at an angle $\alpha$, which plane 22 extends substantially perpendicularly in relation to the longitudinal axis 23 of the housing portion 12 and is indicated schematically in FIG. 1. The angle $\alpha$ lies in the range of approximately 10° to 45°. In this fashion, the end portion 15 is therefore inflected to one side in relation to the housing portion 12 out of the direction of longitudinal extension. As compared to the transverse size of the substantially rod-shaped housing part 12, the transverse size of the end portion 15 increases toward the terminal connection surface 16 with enlargement of the interior space 24 in the end portion 15, because the connection surface 16 and the seating surface 19 are greater than the cross section of the housing portion 12. The battery packet 14, together with its push-in part 20, has an L shape, in known fashion. An electrical switch 25 is arranged in the interior 24 of the end portion 15 in the "L" region of the battery packet 14, which said electrical switch is located on the side of the push-in part 20. By means of this arrangement of the switch 25, which is otherwise located between the drive motor and the battery packet, a shorter design of the electrical tool 10 is achieved. Due to the tilted position of the battery packet 14, the end of the battery packet 14 located at the bottom in FIGS. 1 and 2 does not project over the machine housing 11, or at least not so far that it would interfere. At the same time, space is kept clear for the switch 25, for example. As shown in FIG. 1, the battery packet 14 is situated on the machine housing 11, in particular on the rod-shaped housing portion 12, in described fashion in such a way that a harmonious overall impression is created and the battery packet 14 is integrated harmoniously into the overall appearance of the electrical tool 10. It is further an advantage that the electrical tool 10 has the shortest possible overall length and yields a shorter, handier design compared to battery-operated electrical tools in which, instead, the battery packet is placed at the back of the extension of the rod-shaped housing portion 12. Moreover, the fact that the electrical tool 10 has a more favorable weight distribution and is less tail-heavy is achieved in advantageous fashion. The handiness of the electrical tool 10 is improved. It is additionally an advantage that, due to the inflected arrangement of the battery packet 14, said battery packet is in the way with less interference when working in a cramped position. This applies in particular for angle grinders having designs in which the battery packet 14 does not project over the plane of the sanding disc. The operator of the electrical tool 10 can orient said electrical tool during use in such a fashion that the battery packet 14 is not a hindrance or in the way during operation. The operator can find a position that is optimal for his handling at that time. A further advantage is the fact that, due to the tilted position of the battery packet 14, the operator of the electrical tool 10, e.g., in the form of an angle grinder, is effectively prevented from setting the electrical tool down on the battery packet 14 while the electrical tool is still running or after shutoff but with the tool, e.g., the sanding disc, still running. If the electrical tool 10 would tip over with the tool running, serious risk of injury would exist.

In the second exemplary embodiment of the electrical tool 10 shown in FIG. 2, the same reference numerals are used for the portions that correspond to the first exemplary embodiment. Reference is therefore made to the description of the first exemplary embodiment in order to prevent repetition.

In the second exemplary embodiment in FIG. 2, the end portion 15' is held on the housing portion 12' in a manner that allows it to be adjusted via swiveling around an axis 16 in relation to the housing portion 12', and the axis 26 extends transversely to the longitudinal axis 23 of the housing portion 12'. The pivotable end portion 15' is capable of being moved in both directions via swiveling around the axis 26, as indicated by the arrow 27, and it is capable of being locked in place in swivel positions occupied at the time, in fact by using a manually-actuatable or automatically-acting locking device 28 between the pivotable end portion 15' on one side and the housing portion 12' on the other side. The locking device 28 is indicated only schematically in FIG. 2. It comprises, e.g., a schematically indicated clamping screw 29 and/or coupling 30 acting in positive or non-positive fashion, e.g., realized by means of toothed lock washers or the like. A coupling 30 of this type is indicated in FIG. 2 with dashed lines only. It is understood that the most diverse designs for the locking device 28 are possible according to the invention. Due to the ability of the end portion 15 to be swiveled, the battery packet 14 is therefore capable of being swiveled into any position, e g, between two end positions, and it is capable of being locked in place in the swivel position occupied at that time. As a result, the operator can use the end portion 15' to move the battery packet 14 into a position that is optimal for the specific application, in which said position the battery packet 14 is not in the way in irritating fashion during operation.

What is claimed is:

1. A battery-operated electrical tool (10), such as an angle grinder, die grinder, or finecut power handsaw, comprising a machine housing (11) that has a longish, substantially rod-shaped housing portion (12) having a longitudinal axis (23) and containing an electric drive motor (13), and also has an end portion (15) which has a longitudinal axis and on which a terminal connection surface (16) with push-in receptacle (17) for the detachable attachment of a battery packet (14) is provided, wherein said battery packet is provided with a connection part (18) that comprises a seating surface (19) matched to the connection surface (16) for seating on said terminal connection surface, and comprising a push-in part (20) engaging in the push-in receptacle (17), wherein the terminal connection surface (16) of the end portion (15; 15') extends within a plane (21) that is oriented skew in relation to a plane (22) extending substantially perpendicularly to the longitudinal axis (23) of the housing portion (12), wherein the end portion is oriented at an angle relative to a directly neighboring handle, wherein said handle has a common axis with the housing portion, and the longitudinal axis of the end portion (15, 15') is oriented at an angle relative to the longitudinal axis (23) of the housing portion (12), and wherein the battery packet (14) with its push-in part (20) is substantially L-shaped, and an electrical switch (25) is contained in an interior (24) of the end portion (15) next to the inserted push-in part (20) in a direction transverse to the longitudinal axis of the end portion (15, 15').

2. The battery-operated electrical tool according to claim 1, wherein the connection surface plane (21) extends at an angle approximately 10° to 45° from the plane (22) which is oriented substantially perpendicularly to the longitudinal axis (23) of the housing portion (12).

3. The battery-operated electrical tool according to claim 1, wherein the end portion (15) is inflected toward one side in relation to the housing portion (12) out of the direction of longitudinal extension.

4. The battery-operated electrical tool according to claim 1, wherein a width of the end portion (15; 15') increases toward the terminal connection surface (16).

5. The battery-operated electrical tool according to claim 1, wherein a width of the terminal connection surface (16) is greater than the width of the substantially rod-shaped housing portion (12).

6. The battery-operated electrical tool according to claim 1, wherein the end portion (15') is held on the housing portion (12') in a manner that allows it to be adjusted in relation to said housing portion via swiveling around an axis(26) oriented transverse to the longitudinal extension of the housing portion (12').

7. The battery-operated electrical tool according to claim 6, wherein the pivotable end portion (15') is capable of being locked in place in various swivel positions occupied one at a time.

8. The battery-operated electrical tool according to claim 7, characterized by a manually-actuatable or, automatically-acting locking device (28) between the pivotable end portion (15') and the housing portion (12').

9. The battery-or operated electrical tool according to claim 8, wherein the locking device (28) has a clamping screw (29) or coupling (30) acting in positive or non-positive fashion.

* * * * *